US005951344A

United States Patent [19]

Tsunoda et al.

[11] Patent Number: 5,951,344

[45] Date of Patent: Sep. 14, 1999

[54] OUTBOARD ENGINE

[75] Inventors: Masaki Tsunoda; Tetsu Wada, both of Wako, Japan

[73] Assignee: Honda Giken Kogyo Kabushiki Kaisha, Tokyo, Japan

[21] Appl. No.: 08/989,994

[22] Filed: Dec. 12, 1997

[30] Foreign Application Priority Data

Dec. 19, 1996 [JP] Japan ..... 8-339670

[51] Int. Cl.[6] ..... B63H 21/32

[52] U.S. Cl. ..... 440/89; 123/572

[58] Field of Search ..... 440/88, 89, 900, 440/53; 123/41.86, 572, 574

[56] References Cited

U.S. PATENT DOCUMENTS 5,514,015 5/1996 Okazawa et al. ..... 440/88

FOREIGN PATENT DOCUMENTS 5-149124 6/1993 Japan .

*Primary Examiner*—Jesus D. Sotelo

*Attorney, Agent, or Firm*—Merchant & Gould P.C.

[57] ABSTRACT

An outboard engine includes a cylinder block having a breather passage, an opening provided sideways of and communicating with the breather passage, and a breather chamber disposed at the opening. The breather chamber is provided in a space defined between the cylinder block and an intake manifold positioned laterally of the cylinder block, and communicates with an intake air silencer chamber of the engine via a communication pipe. Making good use of the space, the breather chamber is disposed laterally of the cylinder block in the space, not axially of an engine cylinder as in a conventional arrangement, thereby reducing the axial length of the engine and making the latter compact.

3 Claims, 4 Drawing Sheets

OUTBOARD ENGINE

BACKGROUND OF THE INVENTION

1. Field of the Invention

The present invention relates to an outboard engine with a blow-by gas returning apparatus positioned in such a manner as to make good use of space to thereby render the engine compact in construction.

2. Description of the Related Art

A breather apparatus for a vertical outboard engine is known from, for example, Japanese Patent Laid-Open Publication No. HEI 5-149124 entitled "BREATHER APPARATUS FOR VERTICAL FOUR-STROKE ENGINE". The disclosed breather apparatus is comprised of a head breather chamber forming a first breather chamber disposed on an outer surface of an engine head cover, PCV (positive crankcase ventilation) hose extending from the head breather chamber to a surge tank located downstream of a throttle body, a crank breather chamber forming a second breather chamber disposed on an outer surface of a crankcase, and a blow-by hose extending from the crank breather chamber to a flow control pipe located upstream of the throttle body.

The breather chamber of the breather apparatus takes the form of a maze to have a large capacity so that an engine oil contained in a blow-by gas can be effectively separated from the blow-by gas. The breather apparatus also enables efficient exchange between the blow-by gas in a crank chamber and fresh air during a part-load operation of the engine.

However, in the breather apparatus, the head breather chamber is provided in the head cover while the crank breather chamber is provided in the crank case. That is, since it has the breather chambers provided at both ends thereof, the engine is elongated axially of the cylinders, thus occupying a large space of the outboard engine. Moreover, provision of the breather chambers at both ends of the engine causes the center of gravity of the engine to be displaced outwardly, thus resulting in imbalanced mounting of the outboard engine to a boat.

SUMMARY OF THE INVENTION

It is therefore an object of the present invention to provide an outboard engine which is made compact by reducing the axial length of a cylinder of the engine.

According to an aspect of the present invention, there is provided an outboard engine including a cylinder block, a cylinder head, a crankcase and a valve system chamber disposed laterally of the cylinder head, the valve system chamber communicating with the inside of the crankcase via a breather passage provided in the cylinder block, the outboard engine further comprising an opening provided sideways of and communicating with the breather passage, a breather chamber communicating with the opening, and an intake air silencer chamber communicating with the breather chamber.

In the inventive arrangement, the breather chamber is not disposed axially of a cylinder but laterally of the breather passage of the cylinder block, so that the axial length of the engine can be reduced. As a result, the engine is made compact.

In a preferred form of the embodiment, the breather chamber is provided in a space defined between the cylinder block and an intake manifold disposed sideways of the cylinder block. Thus, good use is made of the space between the cylinder block and the intake manifold.

BRIEF DESCRIPTION OF THE DRAWINGS

A preferred embodiment of the present invention will hereinafter be described in detail, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
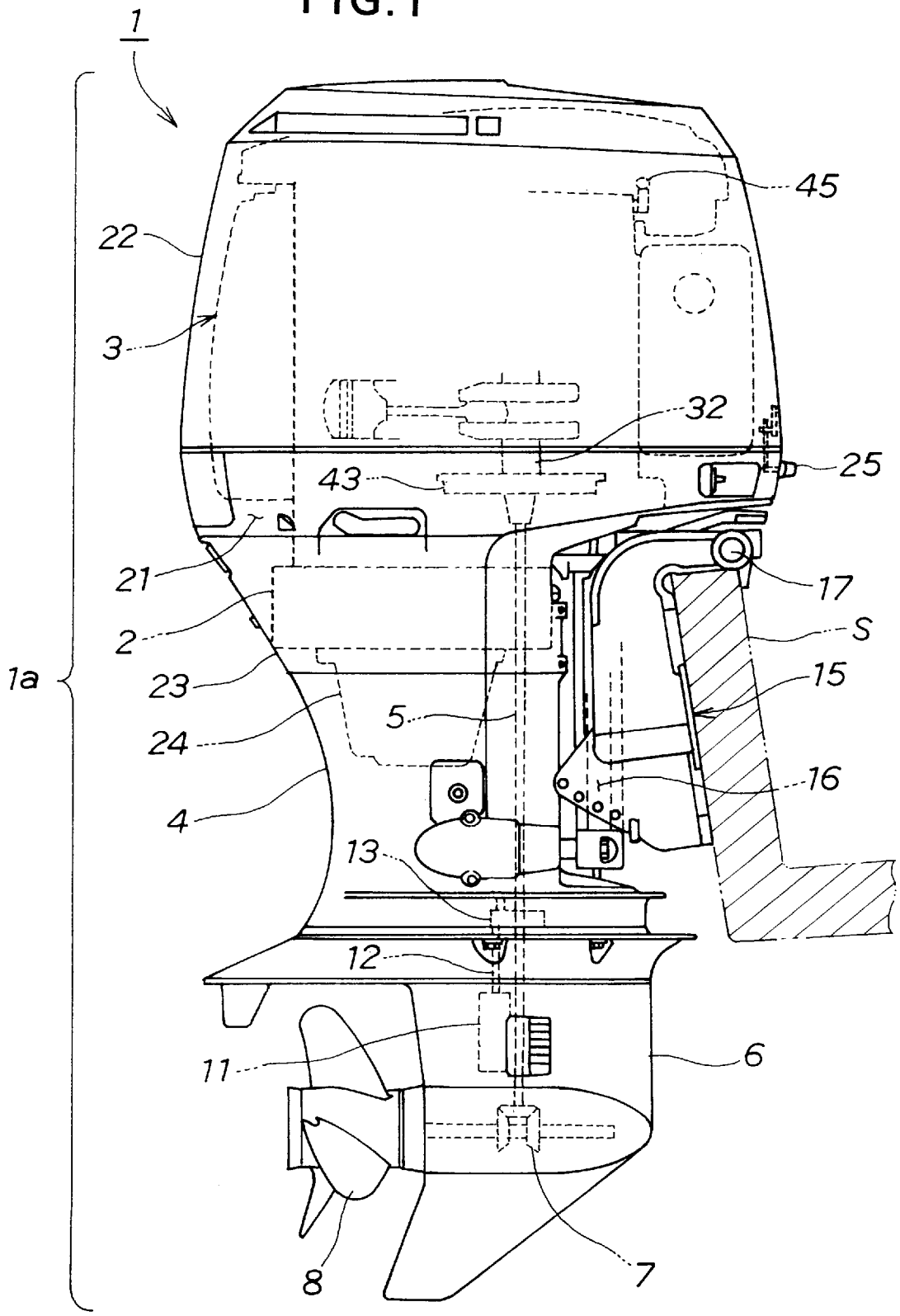
FIG. 1 is a side elevational view illustrating an outboard engine, as attached to a boat, embodying the present invention.

Referring initially to FIG. 1, an outboard engine 1 comprises an engine body 1*a* and an engine mounting mechanism 15 for mounting the engine body 1*a* to a boat S.

Engine body 1*a* includes a vertical multi-cylinder engine 3 which is mounted to a mount case (engine support case) 2. Located below the mount case 2 is an extension case 4 defining an exhaust gas expansion chamber therein. A vertical drive shaft 5 passes through the extension case 4 for transmitting a motive power from the engine 3 to a propeller 8.

Gearcase 6 is disposed below the extension case 4. Within the gearcase 6, there is housed a bevel gear set 7 for shifting the forward and backward movements of the boat S. The propeller 8 is connected to an axle of the bevel gear and rotates in response to a driving force transmitted through the drive shaft 5. Within the extension case 4 and gearcase 6, there are provided cooling water screen 11, a cooling water supply pipe 12, and a water pump 13.

Engine mounting mechanism 15 comprises metal fittings for securing the engine body 1*a* to the boat S. The engine mounting mechanism 15 supports the engine body 1*a* swingably about a swivel axis 16 in a front-and-rear direction of the figure. The engine body 1*a* is supported rotatably about a tilt axle 17 in a clockwise direction of the figure.

Engine 3 is covered by an engine cover 22 and an undercase 21. The undercase 21 and engine cover 22 are releasably connected together via a lock 25. Located below the undercase 21 is an undercover 23 for covering the mount case 2. The undercover 23 performs an ornamental function. An oil pan 24 is located below the mount case 2.

Figure 2:
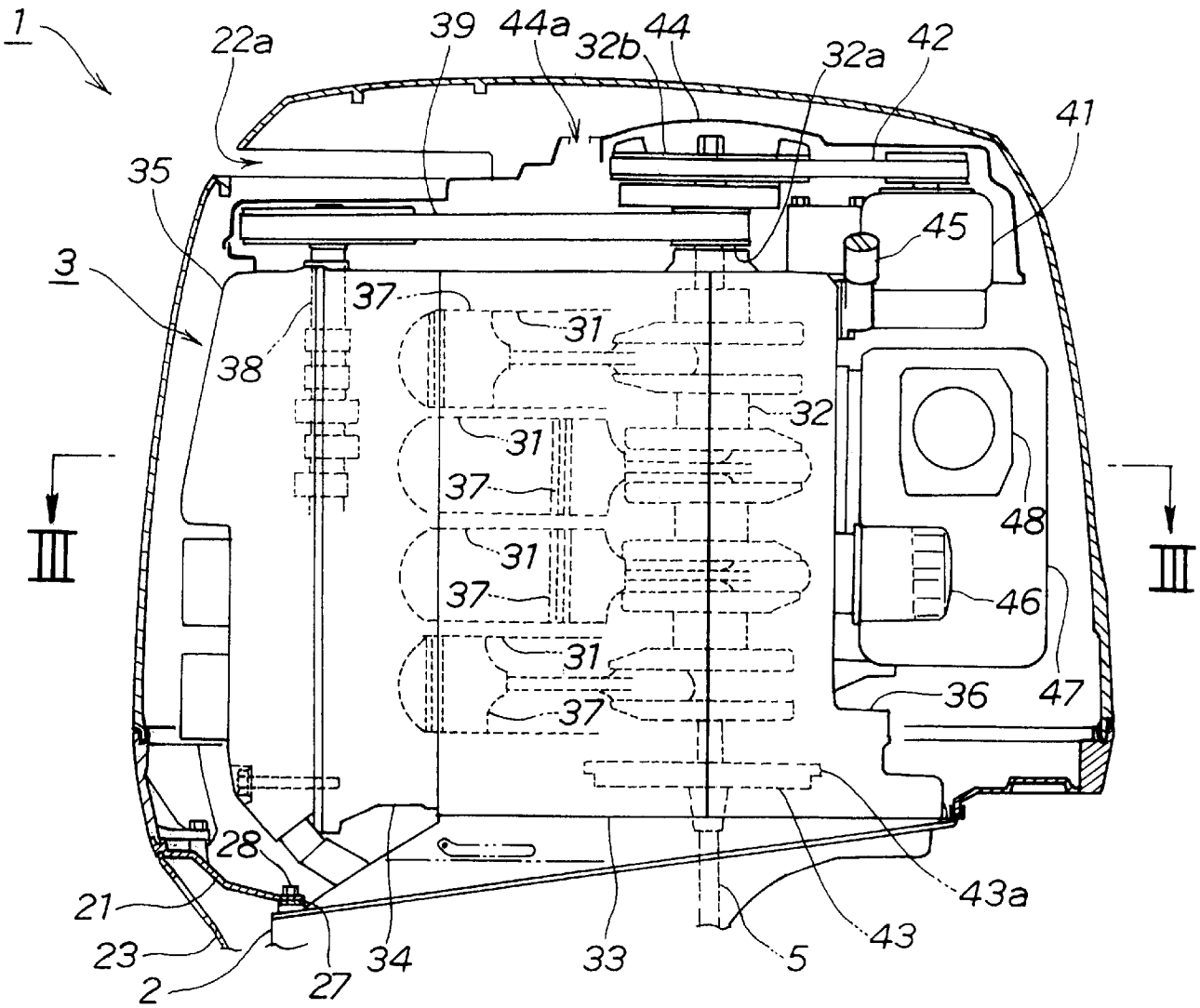
FIG. 2 is an enlarged view illustrating, partially in section, an engine body housed in the outboard engine.

Turning now to FIG. 2, the vertical multi-cylinder engine 3 is comprised of, for example, a water-cooled four-cycle (four-cylinder) engine. A plurality of cylinders 31 are arranged in vertical juxtaposition and extend substantially horizontally. A crankshaft 32 extends vertically. Thus, both the joining plane at which a cylinder block 33 and a cylinder head 34 meet and the joining plane at which the cylinder head 34 and a head cover 35 meet stand substantially vertical.

Engine 3 is positioned in lateral orientation so that the cylinder head 34 and head cover 35 are located rearwardly (left side in FIG. 1) of the outboard engine 1.

Reference numeral 36 designates a crankcase connected to the cylinder block 33 via bolts. Reference numeral 37 denotes a piston in each cylinder 31.

A first pulley 32*a* and a second pulley 32*b* are connected to an upper part of the crankshaft 32. A camshaft 38 is driven via a first belt 39 extending around the first pulley 32*a* while an AC generator 41 is driven via a second belt 42 extending around the second pulley 32*b*. Reference numeral 44 designates a belt cover for covering the first belt 39 and second belt 42. The belt cover 44 has a vent hole 44*a* for expelling air inside the belt cover 44 out of the engine cover 22. The engine cover 22 has an air intake port 22*a* formed at an upper part thereof. A flywheel 43 with a ring gear 43*a* is mounted to a lower part of the crankshaft.

An oil injection port 45 is provided on a front side of the crankcase 36 in an inclined fashion. Reference numeral 46 designates an oil filter. An intake air silencer (induction box) 47 defines an intake air silencer chamber therein. Designated by reference numeral 48 is a throttle valve device.

Undercase 21 is secured through an anti-vibration rubber 27 to the mount case 2 by a bolt 28.

Figure 3:
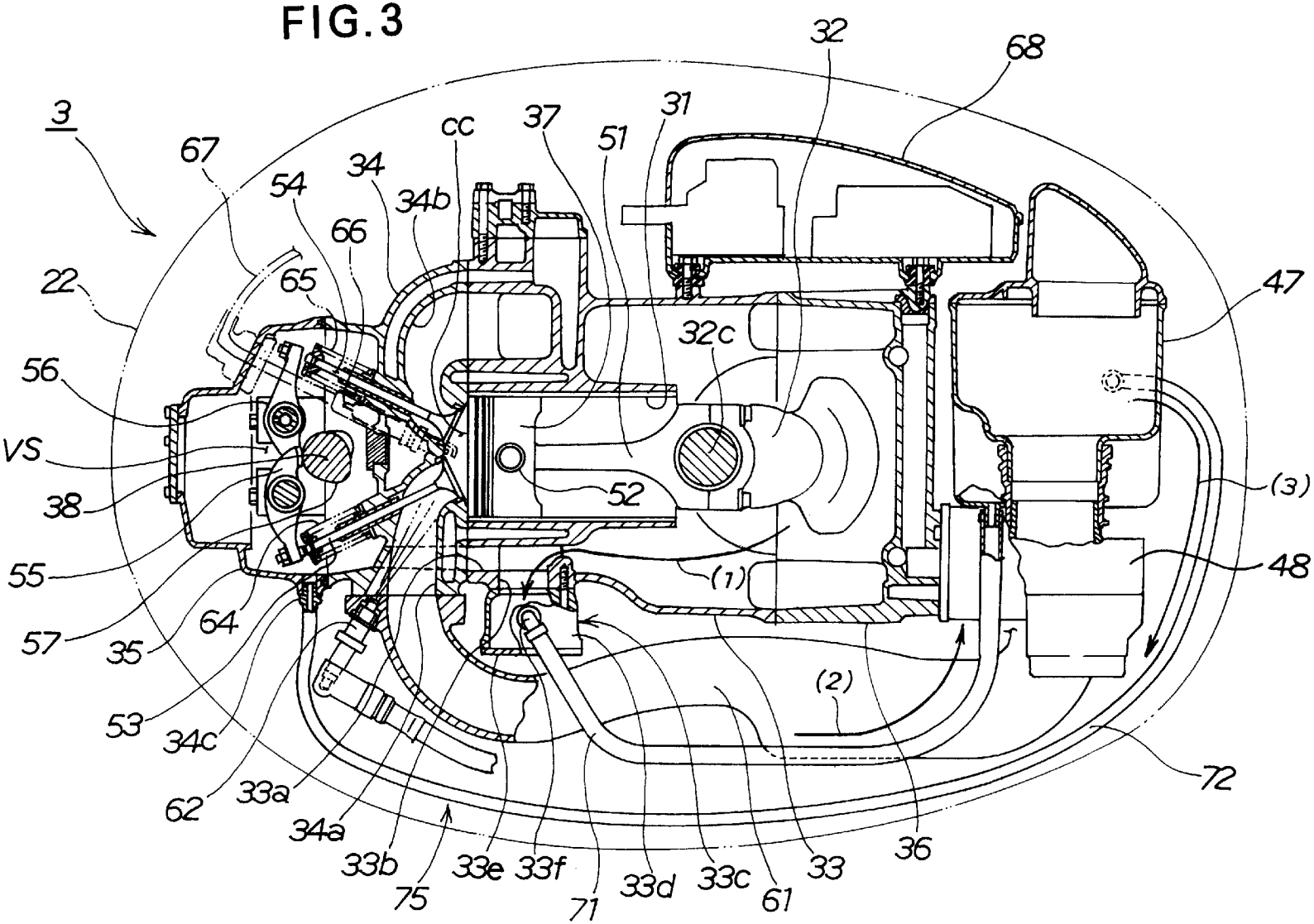
FIG. 3 is an enlarged sectional view taken along line III—III of FIG. 2.

Referring now to FIG. 3, the crankshaft 32 rotatably mounted to the cylinder block 33. One end of a con'rod (connecting rod) 51 is rotatably connected to a crankpin 32*c* of the crankshaft 32. The piston 37 is mounted to an opposite end of the con'rod 51 via a piston pin 52. The piston 37 is inserted into the cylinder 31 horizontally movably.

Cylinder head 34 has an intake valve 53 for opening and closing an intake port 34*a* and an exhaust valve 54 for opening and closing an exhaust port 34*b*. Ends of the intake valve 53 and exhaust valve 54 are in contact with respective one end of rotatable rocker arms 55 and 56. Opposite ends of the rocker arms 55, 56 are in contact with a cam surface 57 of the camshaft 38. The cylinder head 34 is mounted to the cylinder block 33. Reference character CC designates a combustion chamber. Reference character VS designates a valve system chamber defined by the cylinder head 34 and the head cover 35. 64 designates a valve spring for the intake valve 53 while 65 designates a valve spring for the exhaust valve 54. 66 designates an ignition plug. 67 designates a high-tension cord.

An intake manifold 61 is connected at one end to the cylinder head 34 and to the throttle valve device 48 at an opposite end thereof. The intake air silencer 47 is disposed upstream of the throttle valve device 48. A fuel injector valve 62 is provided on the intake manifold 61 closely to the cylinder head 34. Designated by reference numeral 68 is an electric parts box for accommodating an ignition coil and a capacitor discharge ignition (CDI) unit.

Cylinder block 33 comprises a plurality of breather passages 33*a* (only one shown in the figure) extending from the cylinder block 33 to the cylinder head 34, a plurality of openings 33*b* (only one shown in the figure) disposed laterally of and communicating with the breather passages 33*a*, and a plurality of breather chambers 33*c* (only one shown in the figure) communicating with the openings 33*b*.

Each breather chamber 33*c* is defined by a case 33*d* and a lid 33*e*. A connecting pipe 33*f* is attached to the case 33*d*. The breather chamber 33*c* is connected to the intake air silencer 47 through a blow-by gas recycling pipe 71.

Valve system chamber VS defined by the head cover 35 and cylinder head 34 communicates with the silencer chamber of the intake air silencer 47 through the connecting pipe 34*c* and a fresh air introducing pipe 72. Desirably, a one-way valve is provided at an intermediate portion of the fresh air introducing pipe 72 so that ventilation of the crankcase 36 is effected positively.

Blow-by recirculating device 75 is composed of the breather chamber 33*c*, connecting pipe 33*f*, blow-by recycling pipe 71, connecting pipe 34*c* and fresh air introducing pipe 72.

As described above, the breather chamber 33*c* is disposed sideways of the breather passage 33*a* of the cylinder block 33 and not longitudinally of the cylinder 31. As a result, it becomes possible to reduce the longitudinal dimension of the cylinder 31, thereby making the engine 3 compact.

With the one end of the intake manifold 61 connected to the intake port 34*a* of the cylinder head 34 and curved to allow smooth flowing of an intake air, there is provided a space between the cylinder block 33 and the curved portion of the intake manifold 61. Making good use of the space, the breather chamber 33*c* is provided in the space.

Figure 4:
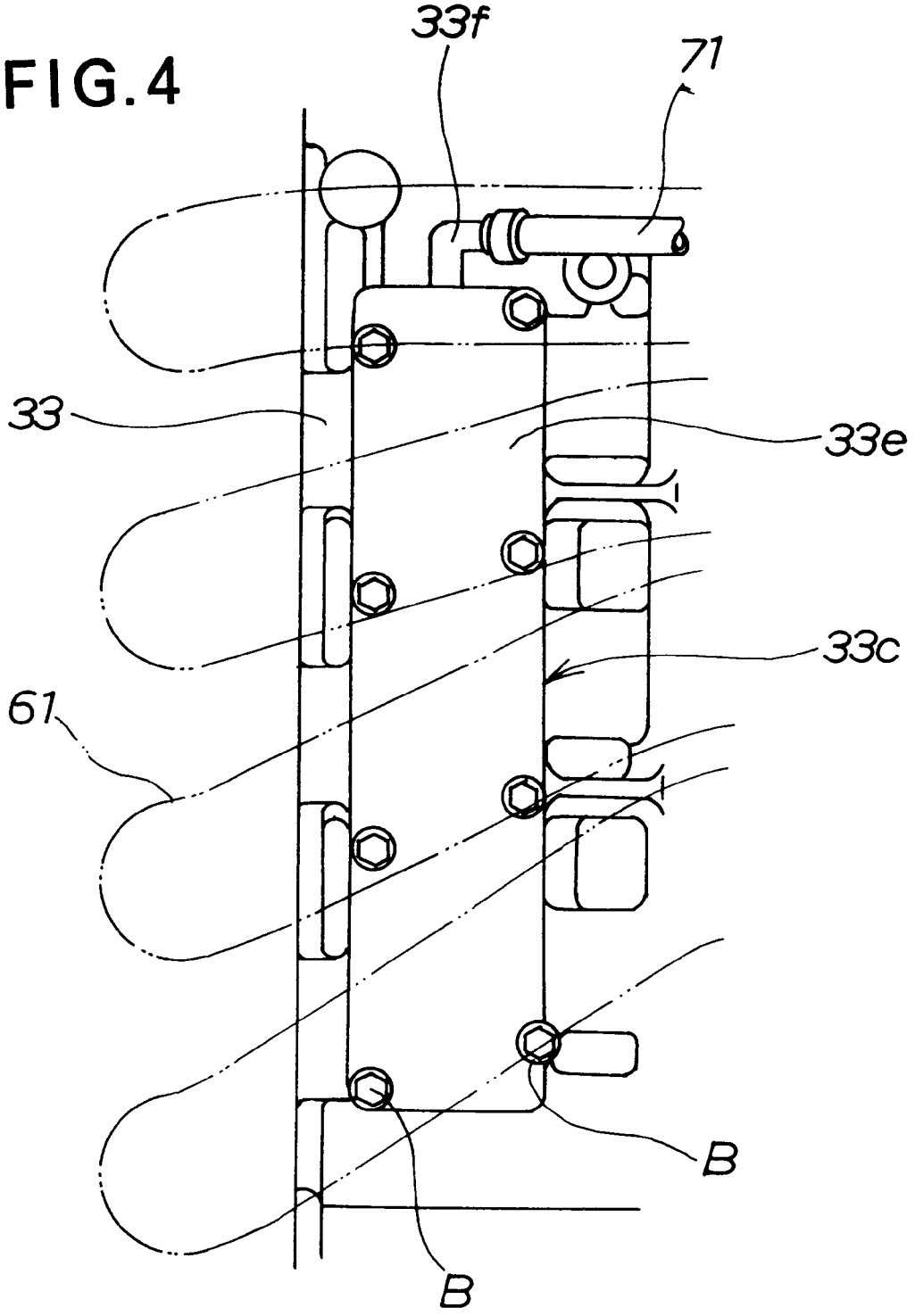
FIG. 4 is a side elevational view illustrating a breather chamber of the outboard engine.

FIG. 4 illustrates the breather chamber 33*c* in side elevation. As shown in FIG. 4, the breather chamber 33*c* is provided by fixing the lid 33*e*, forming the breather chamber 33*c*, by means of bolts B such that it extends longitudinally (up-and-down direction in the figure) of the crank-shaft 32 (see FIG. 2). The connecting pipe 33*f* is connected to an upper part of the breather chamber 33*c*.

By thus arranging the breather chamber 33*c* to extend vertically of the outboard engine, the breather chamber 33*c* is imparted increased capacity so that it can sufficiently separate an engine oil from a blow-by gas upon its passage therethrough. As a result, only a blow-by gas is recycled, preventing recirculation of an engine oil.

Operation of the blow-by recycling apparatus will now be explained.

In FIG. 3, a blow-by gas leaked from the combustion chamber CC into the crankcase 36 flows from the crankcase 36 through the cylinder block 33 into breather chamber 33*c* via the breather passage 33*a* and opening 33*b*, as shown by arrow (1). In the breather chamber 33*c*, an engine oil portion mixed into the blow-by gas is separated from the latter and returned to the crankcase while the separated or remaining blow-by gas portion is recycled through the blowby gas recycling pipe 71, intake air silencer 47 and intake manifold 61 back to the combustion chamber CC, as shown by arrow (2), where it is combusted.

The blow-by gas is recycled as explained above while the fresh air within the intake air silencer 47 flows via the fresh air introducing pipe 72 through the valve system chamber VS within the head cover 35 into the crankcase 36 to thereby complete the crankcase ventilation. Particularly, PCV (positive crankcase ventilation) is achieved by providing the one-way or check valve at the midway of the fresh air introducing pipe 72.

In relation to the embodiment of the present invention, the breather chamber 33*c* has been described as being rectangular in cross section. However, it may take other configurations. For example, it may be semicircular. It may also be curved such that it extends along the profile of the intake manifold 61. It may be configured to utilize the unused space (rightward of the breather chamber 33*c* of FIG. 3) between the cylinder block 33 and the intake manifold 61.

Obviously, various minor changes and modifications of the present invention are possible in the light of the above teaching. It is to be understood that within the scope of the appended claims the present invention may be practiced otherwise than as specifically described.

What is claimed is:

1. An outboard engine including a cylinder block, a cylinder head, a crankcase, and a valve system chamber disposed laterally of the cylinder head, the valve system chamber and the inside of the crankcase communicating with each other via a breather passage provided in the cylinder block, said outboard engine further comprising:

an opening provided laterally of and communicating with said breather passage of said cylinder block;

a breather chamber communicating with said opening; and an intake air silencer chamber communicating with said breather chamber.

2. An outboard engine according to claim 1, wherein said breather chamber is provided in a space defined between said cylinder block and an intake manifold disposed laterally of said cylinder block.

3. An outboard engine according to claim 1, wherein said breather chamber is defined by a case and a lid.

* * * * *